US005426359A

United States Patent [19]

Koblitz et al.

[11] Patent Number: 5,426,359

[45] Date of Patent: Jun. 20, 1995

[54] CIRCUIT FOR GENERATING VERY SMALL CURRENTS

[75] Inventors: Rudolf Koblitz, Meylan, France; Volker Neiss, Villingen-Schwenningen, Germany

[73] Assignee: Deutsche Thomson-Brandt GmbH, Villengen-Schwenningen, Germany

[21] Appl. No.: 129,279

[22] Filed: Sep. 30, 1993

[30] Foreign Application Priority Data

Apr. 10, 1991 [DE] Germany ..... 41 11 584.7

[51] Int. Cl.[6] ..... G05F 3/16; G05F 3/20

[52] U.S. Cl. ..... 323/315

[58] Field of Search ..... 323/315, 311, 312

[56] References Cited

U.S. PATENT DOCUMENTS

| | | | |
|---|---|---|---|
| 3,867,685 | 2/1975 | Ahmed | 323/4 |
| 3,921,013 | 11/1975 | Ahmed | 307/296 |
| 3,952,257 | 4/1976 | Schade, Jr. | 330/22 |
| 4,030,042 | 6/1977 | Limberg | 330/18 |
| 4,045,694 | 8/1977 | Ahmed | 307/296 |
| 4,055,774 | 10/1977 | Ahmed | 307/296 |
| 4,225,816 | 9/1980 | Schade, Jr. | 323/4 |
| 4,673,867 | 6/1987 | Davis | 323/315 |

FOREIGN PATENT DOCUMENTS

| | | |
|---|---|---|
| 366253 | 5/1990 | European Pat. Off. . |
| 3139166 | 8/1992 | Germany . |

*Primary Examiner*—R. Skudy
*Assistant Examiner*—E. To
*Attorney, Agent, or Firm*—Joseph S. Tripoli; Eric P. Herrmann; Ronald H. Kurdyla

[57] ABSTRACT

The relationship of a reference current of a current balancing circuit to a first output current at the collector of an output transistor is adjusted via the dimensioning of a first resistance R in the emitter of the output transistor of a current balancing circuit. By adding a second current balancing circuit with a second resistor R′ contained therein and which provides a second output current, there results, for R=R′, the relationship of the first output current to the second output current corresponding to the relationship of the reference current to the first output current.

7 Claims, 1 Drawing Sheet

CIRCUIT FOR GENERATING VERY SMALL CURRENTS

This is a continuation of PCT application PCT/EP 92/00774, filed Apr. 6, 1992, and titled CIRCUIT FOR GENERATING VERY LOW CURRENTS. The invention relates to circuitry for generating very small currents.

BACKGROUND OF THE INVENTION

Very small currents, for example, in the nA range, may be generated by current balancing (reflection) with the aid of multiple emitter circuits, but the currents generated in such manner are dependent upon parameter tolerances and temperature. In addition, such circuits require relatively large chip area if they are implemented in integrated circuits. Examples of the foregoing current balancing circuits may be found in U.S. Pat. Nos. 3,867,685; 3,952,257; 4,030,042; 4,045,694; 4,055,774; 4,225,816. It is the object or the present invention to specify a circuit with which very small currents can be generated.

SUMMARY OF THE INVENTION

In principle, the invention consists of current balancing circuitry which is coupled with further circuitry for modifying the size of the balanced current, whereby the relationship of a reference current ($I_{ref}$) applied to the current balancing circuitry to a current ($I_{out}$, $I_{out}'$) made available by the size modification circuitry can be adjusted using one or more components (R, R') contained in the size modification circuitry. The current balancing circuitry and the circuitry for modifying the size of the current each may contain one or more transistors, and the adjustment component contained within the size modification circuitry can consist of one resistor (R) or several resistors (R, R').

The relationship of the reference current of the current balancing circuit to the first output current at the collector of the output transistor can be adjusted by reducing the value of a first resistance in the emitter of the output transistor of a current balancing circuit. By adding a second current balancing stage with a second resistor R' contained therein and with a second output current, there results, for R=R', the relationship of the first output current to the second output current corresponding to the relationship of the reference current to the first output current whereby only a relatively small chip area is necessary when using an integrated circuit.

DETAILED DESCRIPTION

Figure 1:
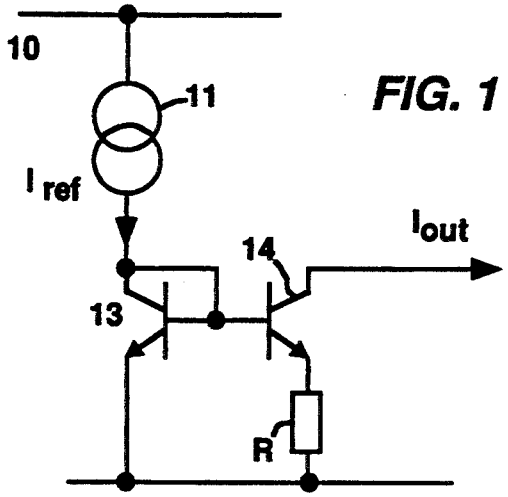
FIG. 1 is a schematic diagram of a current balancing stage.

Referring to FIG. 1, a current balancing stage includes an unbalanced current mirror amplifier circuit including a master transistor 13 and a slave transistor 14. The master transistor 13 has base and collector electrodes interconnected and coupled to a source of reference current ($I_{ref}$) 11. An emitter electrode of the master transistor 13 is connected to ground potential. The base electrode of the slave transistor 14 is connected to the base electrode of master transistor 13. The emitter electrode of the slave transistor 14 is coupled to ground potential through an impedance component such as a resistor R, and output current Iout is available from a collector electrode of transistor 14. The ratio of $I_{ref}$ to $I_{out}$ can be adjusted via the dimensioning of the impedance component, e.g. the resistance of resistor R $$I_{out}* R=U_T* \ln(I_{ref}/I_{out}),$$

where $U_T$ is the thermal voltage of the respective transistors, which are presumed to be in close proximity such that both transistors exhibit the same temperature. $I_{out}$ can be further reduced by forming the master transistor 13 as a multiple transistor. Then the following relationship is valid:

$$I_{out}* R=U_T* \ln(I_{ref}*k/I_{out}),$$

where k is the number of transistors connected in parallel forming the master transistor, each of which is identical in geometry or conductance as the slave transistor 14. Alternatively, the transistor 13 may be constructed in any known manner which permits of forming different transistors with relative conductances which are highly predictable, such as transistors with different pluralities of similar base-emitter junctions or transistors with different relative geometry's where relative conductance of respective transistors may be accurately predicted by their relative geometric features.

Figure 2:
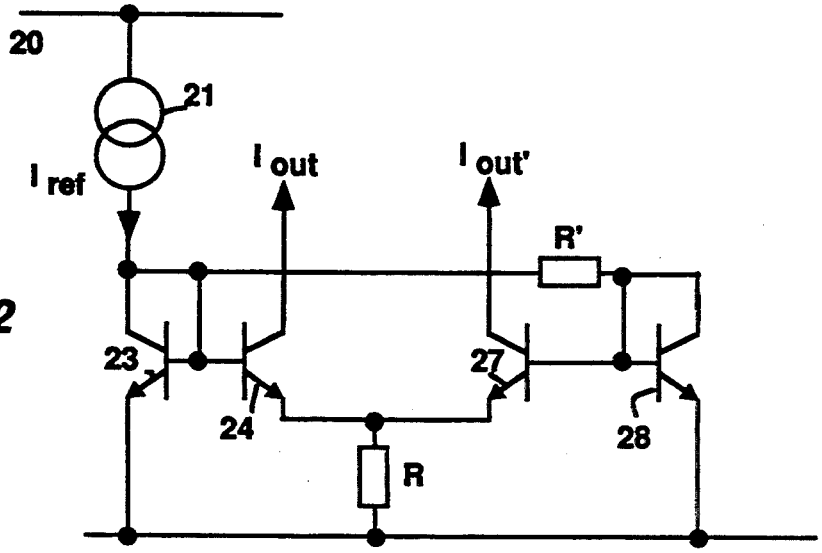
FIGS. 2 and 3 are schematic diagrams of alternative current balancing circuits embodying the present invention.

FIG. 2 illustrates a graded current balancing circuit having a composite current mirror including a source of reference current (Iref) 21, first current master transistor 23, a first slave transistor 24 and a resistor R, connected similarly to the corresponding elements in FIG. 1. The collector of the first slave transistor 24 supplies the output current $I_{out}$. A further impedance component, e.g., resistor R' is coupled between the base electrode of the master transistor 23, and the base electrode of a transistor 28. Transistor 28 has a collector electrode connected to its base electrode and an emitter electrode connected to ground potential.

The base-collector interconnection of transistor 28 is connected to the base electrode of a transistor 27. Transistor 27 has an emitter electrode coupled to the emitter electrode of slave transistor 24 and a collector electrode from which a further output current, Iout', is available. The current Iout' has an amplitude which is less than the amplitude of the output current Iout. Transistors 28 and 27 operate as a further current mirror with transistors 28 and 27 operating as master and slave respectively, and resistor R' acting as an input current source. If resistors R and R' are equal the following relationship is valid:

$$I_{out}* R=U_T* \ln(I_{ref}/I_{out}).$$

Advantageously, $I_{out}'$ can be further reduced by arranging transistor 28 as a multiple transistor. Then, for R=R':

$$I_{out}* R=U_T* \ln(I_{ref}/(I_{out}'*n)).$$

where n is the number of transistors connected in parallel to form the transistor 28.

If both of the first transistors 24 and 28 are replaced by k, or respectively, n multiple transistors, then for R=R';

$$I_{out}* R=U_T* \ln(I_{ref}*k/I_{out}),$$

$$I_{out}^* R = U_T^* \ln(I_{ref}/(I_{out}'^* n)).$$

Advantageously with R=R' and k=n=1, there results for $I_{out}/I_{out}'$ the same current ratio as for $I_{ref}/I_{out}$.

In this manner, current sources, for example, for the range 1 . . . 500 nA, may be realized with relatively small silicon area in integrated circuit form. Such current sources are useful in realizing integrated integrator circuits with long integration times, for example, in the range 0.015 . . . 0.06 s, and very small integration capacitances, for example, in the range 5 . . . 20 pF.

Figure 3:
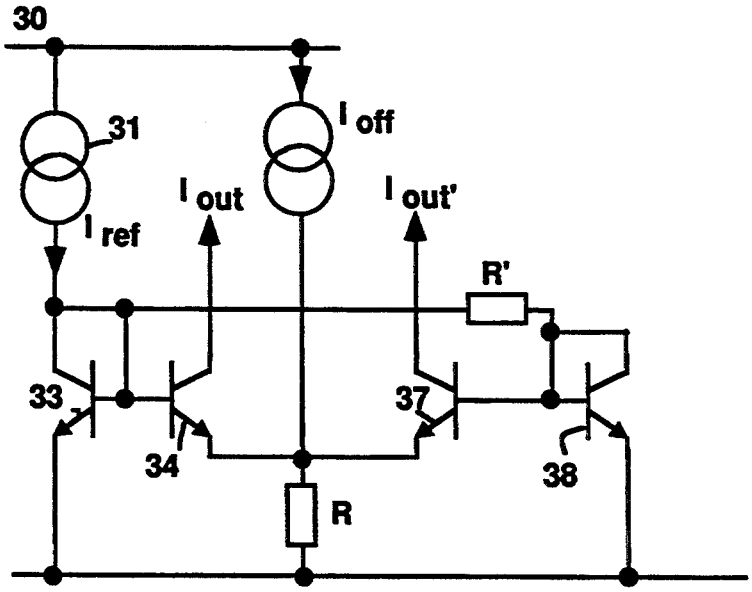

FIG. 3 shows a further embodiment, which is substantially similar to that of FIG. 2, and operates in similar fashion. However the FIG. 3 embodiment includes a switchable current source $I_{off}$ connected to the interconnection of the emitter electrodes of the slave transistors and the resistor R. The current source $I_{off}$, when conditioned to conduct will cause the currents Iout and $I_{out}'$ to be substantially zero.

The magnitude of current $I_{off}$ is equal to or greater than an the amount which will cause the product of $I_{off}$ times R to be greater than or equal to about 0.5 volts. A voltage of this magnitude, at the emitters of transistors 34 and 37, is sufficient to reverse bias the emitter-base junctions of transistors 34 and 37, and thereby cease conduction in the collector electrodes of the transistors 34 and 37.

In the claims the term current source is used in the conventional sense to mean apparatus which provides an output current at an output terminal substantially independent of the voltage potential appearing at the output terminal. The current source may be either a time varying or a constant current source.

What is claimed is:

1. Circuit apparatus for generating currents which are relatively small compared to a reference input current, said apparatus comprising:

a reference input current source having an output terminal;

first, second, third and fourth transistors each having respective first second and control electrodes, with a principal conduction path between said first and second electrodes which is controlled by signal applied between respective control and first electrodes;

a source of reference potential;

a first impedance component coupled between said source of reference potential and an interconnection of the first electrodes of said first and second transistors;

means coupling the control and second electrodes of said third transistor to the control electrode of the first transistor and to the output terminal of said reference input current source, and means for coupling the first electrode of said third transistor to said source of reference potential;

means for coupling the control and second electrodes of said fourth transistor to the control electrode of the second transistor, and means for coupling the first electrode of said fourth transistor to said source of reference potential; and a second impedance component coupled between the control electrodes of said first and second transistors such that relatively small currents are available from the second electrodes of said first and second transistors, and the values of said relatively small currents are a function of the impedance value of the first impedance component.

2. The apparatus set forth in claim 1 wherein said first impedance component is a resistor.

3. The apparatus set forth in claim 1 wherein said second impedance component is a resistor.

4. The apparatus set forth in claim 1 wherein said first and second impedance components are resistors.

5. The apparatus set forth in claim 1 further including a controllable current source coupled to the interconnection of the first electrodes of the first and second transistors, for conditioning said apparatus to terminate said relatively small currents.

6. The apparatus set forth in claim 1 wherein said third transistor is constructed to conduct greater currents than said first transistor for similar bias conditions.

7. The apparatus set forth in claim 1 wherein said fourth transistor is constructed to conduct greater currents than said second transistor for similar bias conditions.

* * * * *